US005218799A

United States Patent [19]

Appino

[11] Patent Number: 5,218,799

[45] Date of Patent: Jun. 15, 1993

[54] PRE-ASSEMBLED GLAZED PANEL WITH TRIM ASSEMBLY FOR WALL PANEL SYSTEMS

[75] Inventor: Bruce R. Appino, Wood Dale, Ill.

[73] Assignee: Allsteel Inc., Aurora, Ill.

[21] Appl. No.: 708,175

[22] Filed: May 31, 1991

[51] Int. Cl.[5] ..... E06B 1/12

[52] U.S. Cl. ..... 52/213; 52/206; 52/475

[58] Field of Search ..... 52/208, 211, 212, 213, 52/616, 617, 475, 476, 657, 656, 308, 206, 475

[56] References Cited

U.S. PATENT DOCUMENTS

| | | | |
|---|---|---|---|
| 3,125,191 | 3/1964 | Singer et al. | 52/476 |
| 3,252,260 | 5/1966 | Mills | 52/308 |
| 3,487,602 | 1/1970 | Braun et al. | 52/656 |
| 3,969,857 | 7/1976 | Stark | 52/656 |
| 4,747,248 | 5/1988 | Fahs | 52/475 |
| 4,924,649 | 5/1990 | Taylor | 52/656 |

FOREIGN PATENT DOCUMENTS

| | | | |
|---|---|---|---|
| 2153419 | 8/1985 | United Kingdom | 52/213 |

OTHER PUBLICATIONS

Teknion Furnuture Systems, Inc., Downsview, Ontario, Canada, 1991 advertising brochure: "The Teknion Office System", pp. 43, 44 and 21, 22; glazed panels and glazed elements.

Herman-Mi-ler, Inc., Zeeland, Michigan, Brochure entitled "Ethospace R Decision Book" 1991, p. 50 Ethospace R partial-height walls; glass window tile.

*Primary Examiner*—Carl D. Friedman
*Assistant Examiner*—Christopher T. Kent
*Attorney, Agent, or Firm*—Lee, Mann, Smith, McWilliams, Sweeney & Ohlson

[57] ABSTRACT

A glazed panel assembly providing a trim frame preassembled with a pane of glass, or the like, for mounting to wall framing of a wall panel system. Snap-engageable corner trim caps cover corner gussets that interconnect trim frame members. A second trim frame attaches to the opposite side of the wall frame and is substantially identical to the first trim frame with the exception of a glazing channel and pane of glass. The second trim frame may also be pre-assembled. Both trim frames are capable of being attached to the wall framing structural members only at the corner gussets to facilitate quick installation and also permit interchangeability with other panels to change the decor of a wall divider system, including the option of having an open panel passthrough instead of a glazed panel.

19 Claims, 5 Drawing Sheets

FIG. 1
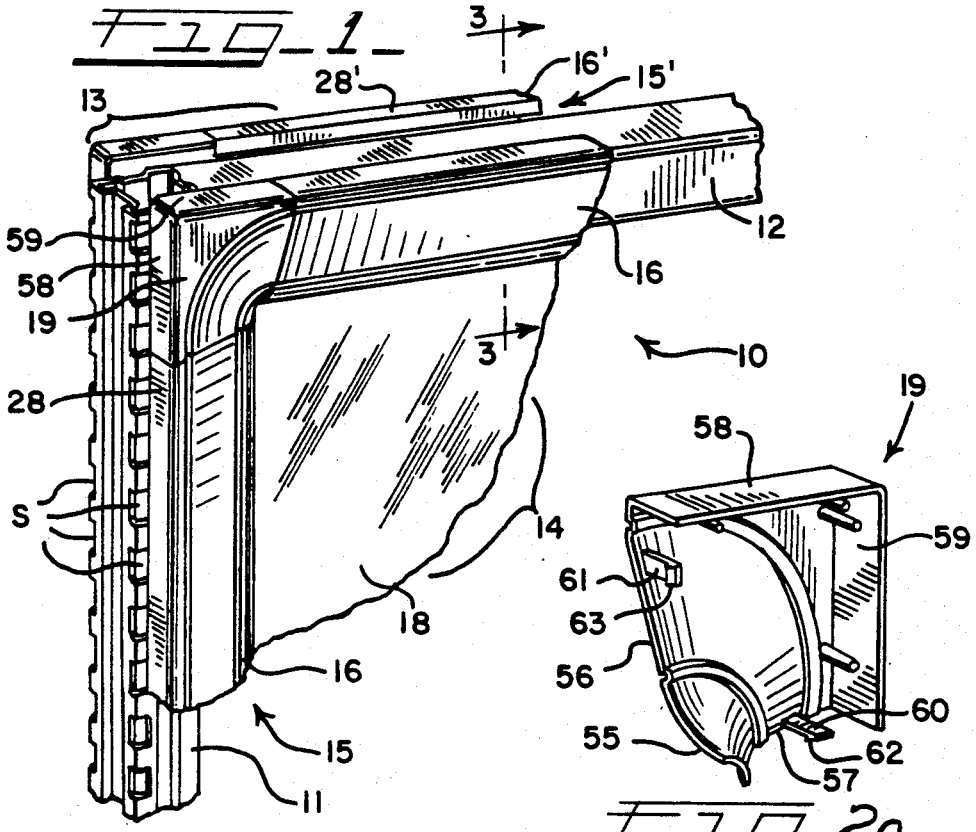
FIG. 2a
FIG. 2
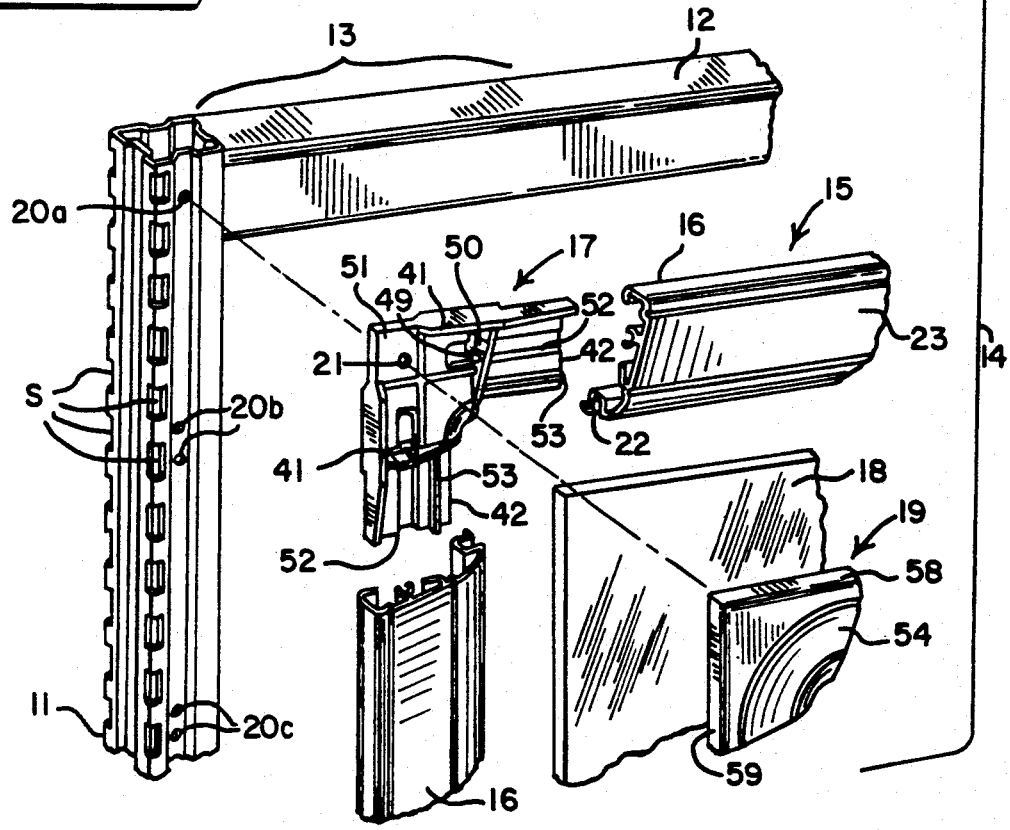

28
25
52
35
48
53
31
11
41
43
42
34
12
22
18

16
43
42
41
6
6
44
45
48
49
47
17
50
46
53
42
41
40
39
45
43
21
46
38
49
51
50
52
41
44
41
16

A
B
C
D
10
64

PRE-ASSEMBLED GLAZED PANEL WITH TRIM ASSEMBLY FOR WALL PANEL SYSTEMS

BACKGROUND OF THE INVENTION

The invention relates to a glazed panel for use in a wall panel system. More particularly, the invention is directed to a pre-assembled glazed panel having trim members for attachment at both sides of a wall support frame, which is interchangeable with, or as a replacement for, other panels in a wall system to provide design flexibility.

Wall panel divider systems, particularly those used to segregate offices into separate work stations, require a great deal of flexibility to satisfy different choices of design and also accommodate various functions performed at different locations in the system. In order to satisfy those needs, it has been a desire in the industry to provide a glazed panel for use in wall panel systems that allows the purchaser to select various configurations and room arrangements.

It is also a need in the wall panel industry to provide a system that offers easy and quick interchangeability of existing decorative/opaque panels with glazed panels in a facile manner.

It is also often desired that a frame be left entirely open to serve as a pass-through or otherwise to provide a more open, airy feel to the office environment. It would therefore be necessary for an interchangeable glazing trim frame to have the capability of either holding a pane or being open, while in both options still providing decorative peripheral features over the wall framing members.

It is also a concern to provide for a self-aligning glazed panel to allow for slightly misaligned or racked structural framing members sometimes caused by uneven flooring or improper framing installation.

Another useful feature would be a glazed panel that has only one pane of glass and also that avoids the problems and high costs of prior art stand-alone panels by virtue of being separable from, or attachable to, space divider system support framing as a sub-assembly.

It would be a great benefit also to provide such a panel that may be pre-assembled requiring only a minimum amount of fastening steps to mount the glazed panel to a wall framing, while concomitantly allowing for the self-alignment means to be adjusted.

It would also be significant achievement to provide for a pre-assembled glazed panel with interconnected trim frames ready for mounting at one side of a panel opening and a substantially identical trim frame provided for attachment to the opposite side, but without glazing. It would therefore be quite helpful for the attachments of the glazed trim frame for the opposite trim frame to be installed substantially with the same steps and tools.

Another important feature would be the provision of a snap-on or friction fit trim piece for covering and concealing attachment fasteners for a glazed trim frame and an unglazed trim frame after the trim frames have been attached and aligned. It would also be helpful if the trim piece were capable of concealing the attachment means, the connections between trim members and the self-aligning means of the trim frames, and also have a matching decorative trim surface so an uninterrupted panel border might be provided to achieve aesthetically pleasing continuity. A related goal would be to provide a pre-assembled glazing panel that may be less than a full-height panel so that partly solid, partly glazed and/or partly open arrangements can be configured at selected locations of a space divider system.

SUMMARY OF THE INVENTION

The invention may be summarized as providing a glazed panel formed of trim frame members supporting a glass, acrylic, or the like, pane. The trim frame has two side frame members and upper and lower frame members joined at right angled corners in a rectangular configuration by corner gussets. The four trim frame members and four corner gussets may be pre-assembled with a pane of glass held therein. The corner gussets include flanges that fit within channels of the trim frame members to reinforce and rigidify the glazed panel. The corner gussets also allow a small sliding adjustment motion for alignment if needed when the pre-assembly is taken to the wall framing for attachment. The corner gussets provide means for screw fastening each to a wall frame support member. The pane of glass is peripherally retained in channels integrally formed along the trim frame members and which may receive an elastomeric molding for seating around the pane edge. A substantially identical set of four trim frame members and four corner gussets are provided for the other side of the wall support framing but without the channels. Instead, the non-glazed trim frame terminates in an opposing mirror-image flange for concealing the channel of the glazed trim frame for meeting the contour of the glazed trim frame member to achieve a finished appearance around the periphery of the glass at both sides thereof.

The invention further includes the provision of a corner trim cap that is frictionally engageable to the corner gussets and has a contour and configuration to match the trim frame members whereby it conceals the corner gussets and thereby the attachment fasteners of the trim frame members to the corner gussets and the fasteners attaching the corner gussets to the wall frame support members.

Accordingly, either or both the glazed trim frame sub-assembly or the non-glazed trim frame sub-assembly may be pre-assembled and then taken to the wall framing for attachment in an accurate efficient manner, while allowing for self-alignment prior to concealment of the corner gussets by the corner trim caps.

The trim frame members may be extruded to include a round tube-like extrusion facilitating the attachment of the corner gussets.

BRIEF DESCRIPTION OF THE DRAWINGS

FIG. 1 is a perspective partial view of a corner of the inventive glazed panel with trim assembly attached at a panel opening along vertical and horizontal wall support framing members;

FIG. 2 is an exploded view of FIG. 1 showing the components of the glazed panel with trim assembly at one side of a panel opening;

FIG. 2*a* is a perspective view of a corner trim cap for concealing interconnective corner gussets;

DETAILED DESCRIPTION OF THE INVENTION

Figure 4:
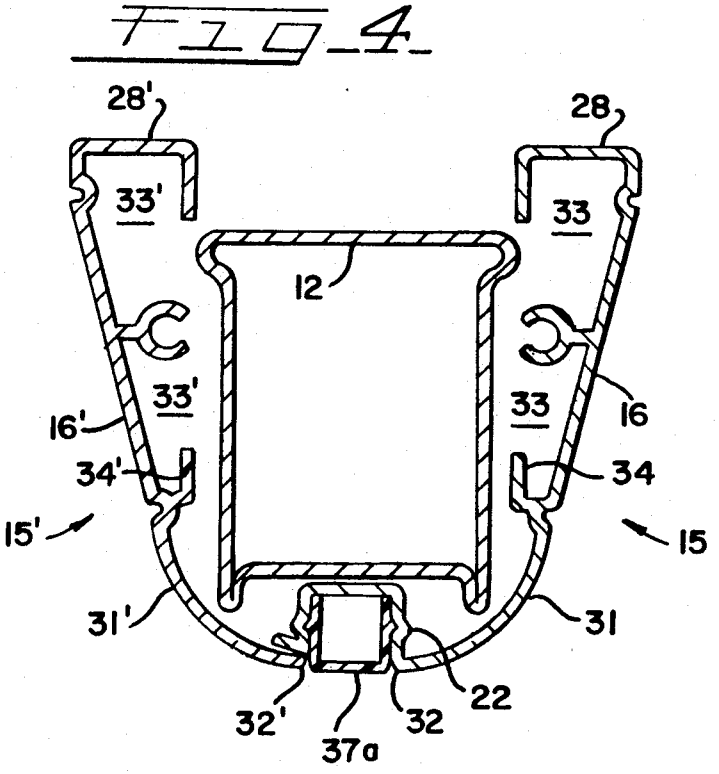
FIG. 4 is a sectional view also taken along line 3—3 of FIG. 1 alternately showing a trim piece located in the glazing channel to provide an open pass-through panel arrangement.

With respect to FIG. 1, a glazed panel with trim assembly, collectively noted at 10, is shown in a perspective view generally at one corner thereof and broken away for illustrative purposes. The assembly 10 is mounted to wall supporting frame members 11, 12 which are, respectively, vertical and horizontal structural framing members for a wall space divider system.

In FIG. 2, the glazed panel with trim assembly 10, is shown exploded at one side of the members 11, 12, to show the components thereof in more detail. The assembly 10 is provided for attachment to both sides, generally noted at 13, 14, respectively, of the support members 11, 12 so that a free-standing wall space divider system may have a coordinated trim arrangement at both sides. The assembly 10 is composed of sub-assemblies 15, 15' attached at sides 13, 14, respectively, of the wall support framing members 11, 12, but only one sub-assembly is formed to have a glazing channel for a pane of glass; the other being substantially identical except for the glazing structure, as will be described in greater detail in the following.

More specifically, in FIG. 2, the sub-assembly 15 is exploded to show the components thereof and includes rectangularly arranged vertical and horizontal trim frame members 16 that are identical in cross-section and interconnected at the four corners of the rectangular shape by corner gussets 17. It will therefore be appreciated that the one corner shown in FIGS. 1 and 2 is typical of the other three corners of a rectangular arrangement. Only one corner need be shown, the others being the same except for orientation. The trim frame members 16 are constructed for holding a pane of glass 18 around the periphery thereof. It is the intention of the invention for the trim frame member 16 to be connected by the corner gussets 17 while holding the glass pane 18 in a pre-assembled arrangement for subsequent attachment to a wall system, as at the framing members 11, 12. A removable corner trim cap 19, best viewed in FIG. 2*a*, is provided to snap-engage to the corner gussets 17 and thereby conceal interconnective fastening means between the trim frame members 16 and the corner gussets 17, and also hide attachment means attaching the corner gussets 17 to the framing members 11, 12.

It is also a great benefit provided by the inventive assembly 10 to be sized to be less than the full height of a wall panel opening of a space divider system. Thus, the framing members 11, 12 are provided with a plurality of vertically spaced attachment apertures 20*a, b, c*, etc., providing means for attaching a corner gusset 17 at anyone thereof. The apertures 20*a, b, c*, are spaced inwardly of attachment slots S which are used for the purposes of attaching hang-on components to the wall panel, such a cabinets and work surfaces, etc., in a generally known way. In the exemplary embodiment, the apertures 20*a, b, c*, are spaced vertically 12 inches center-to-center. Thus, the assembly 10 would provide for the attachment of sub-assemblies 15 having a height in multiples of one foot increments. Of course, the invention is not limited to these vertical dimensions and an assembly 10 may have different sizes to match correspondingly centered apertures 20*a, b, c*, for the attachment thereof.

The corner gussets 17 in the preferred embodiment have tube-like apertures 21 for insertion therethrough of, for example, a screw fastener to attach to the framing apertures 20*a, b, c*. Accordingly, the interconnective corner gussets 17 are not limited to attachment in a wall panel system only at the corner intersections of vertical and horizontal framing members, such as 11, 12. The accomplishment of this goal and other useful features of the invention will be further understood in connection with the description of the other Figures.

The corner gussets 17 serve both to interconnect two trim frame members 16 and to provide rigidification and reinforcement therebehind so that the assembly 10 may achieve the ability to be handled as a pre-assembly for subsequent mounting in a space divider system.

Figure 3:
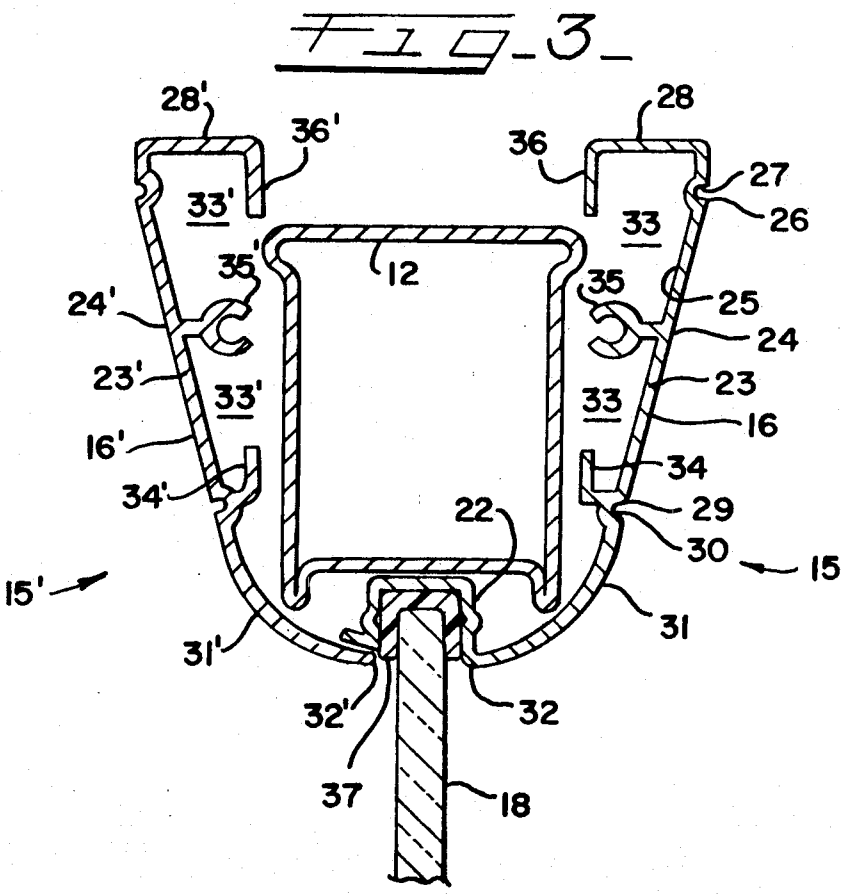
FIG. 3 is a sectional view taken along line 3—3 of FIG. 1 showing the attachment of trim frame sub-assemblies at both sides of the wall panel opening and having a pane of glass held in a glazing channel of a trim frame member.

Reference is now made to FIG. 3 which is a vertical sectional view of the assembly 10 at the horizontal framing member 12. A sectional view taken at the vertical member 11 would be substantially identical with the exception of the different cross-section of the member 11 and its exposed slots S. The trim frame sub-assemblies 15, 15' are substantially identical with the exception that the trim frame members 16 of sub-assembly 15 include glazing channels 22. The trim frame members 16' of the sub-assembly 15' do not have a glazing channel. The specific description of the structure of the trim frame sub-assemblies 15, 15', will therefore be identical except for channels 22, with the understanding that the corresponding elements of trim frame sub-assembly 15' will be designated with the prime symbol "'" in the drawings. Thus, a corner gusset 17' resides on the opposite side 13 of the support frame members 11, 12 in a substantially mirror image of the gusset 17 shown in FIGS. 1 and 2. The sub-assembly 15' having the trim frame members 16' connected at the corner gusset 17', also being capable of pre-assembly as a unit to be subsequently attached to the side 13 of the framing members 11, 12, as would be understood by those skilled in the art.

Turning now to the structure of the trim frame subassembly 15, the trim frame members 16 include a generally central portion 23. The central portion 23 has an exterior trim face 24 and an interior face 25. The central portion 23 terminates at an upper edge 26 which meets a recessed groove 27 that is joined to a top panel-outwardly directed hook flange 28. At the opposite side, the central portion 23 terminates in a lower edge 29 joined at an inward recess groove 30 that joins a lower panel-inwardly directed curved flange 31. The flange 31 terminating at a lower inward edge 32 arranged to opposingly face a corresponding inward edge 32' of the opposing trim frame member 16'. The interior face 25 is formed to define a channel means 33 between hook flange 28 and an up-turned flange 34 extending inwardly generally along the lower edge 29 of the central portion 23.

In the preferred embodiment, the trim frame members 16, 16' are made of extruded aluminum formed to have tube-like elongate extrusions 35, 35' which have a generally C-shape. The extrusions 35, 35' provide means engageable with mechanical fasteners for connection to the corner gussets 17, 17' as will be further explained in connection with FIG. 6 below. The extrusions 35, 35' are located within the channel means 33, 33', respectively.

It will be further apparent from FIGS. 3 and 4, that the top hook flanges 28, 28' include rebated panel-inwardly directed terminal legs 36, 36' that are opposingly directed to the upturned flanges 34, 34' and further define said channel means 33, 33' therebetween. The combination of the top hook flanges 38, 38', the lower curved flanges 31, 31', and the central portions 24, 24', give the trim frame members 16, 16' a generally concavo/convex configuration.

As noted above, the trim frame members 16 each include a glazing channel 22 and the trim frame members 16' do not. The glazing channel 22 extends to be panel-inwardly open and receives a flexible glazing strip 37 for holding a pane, such as the glass pane 18 shown in FIGS. 1-3. The opposing edges 32, 32' of adjacent trim frame members 16, 16' terminate generally adjacent the glazing panel 18 to provide a substantially continuous trimmed periphery around the pane 18, except at the corner joints, as would be clear. The exterior trim face 24 will serve to provide, in combination with the top hook flange 28 and lower curve flange 31, an exterior trimmed appearance over the framing members 11, 12. Painting, decorative embossments, relief patterns, ornamentation, and the like, may be provided along the exterior of the trim frame member 16, and may be chosen to meet aesthetic and ornamental design requirements as needed.

Turning to FIG. 4, the arrangements of the trim frame members 16, 16' along sides 14, 13, are the same as in FIG. 3 with the exception that the glazing channels 22 of the trim frame members 16 receive only a trim strip 37*a*, whereby the assembly 10 therefore may optionally provide an open pass-through bounded therearound by the trim strips 37*a*.

Figure 6:
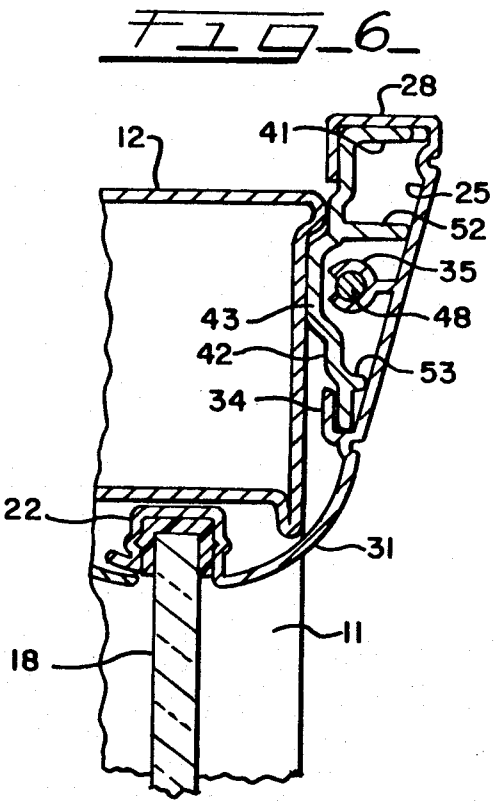
FIG. 6 is a vertical sectional view taken along lines 6—6 of FIG. 5 and showing the reinforcing attachment of the corner gusset to a trim frame member and the trim frame member retaining a pane of glass along a glazing channel thereof.
Figure 5:
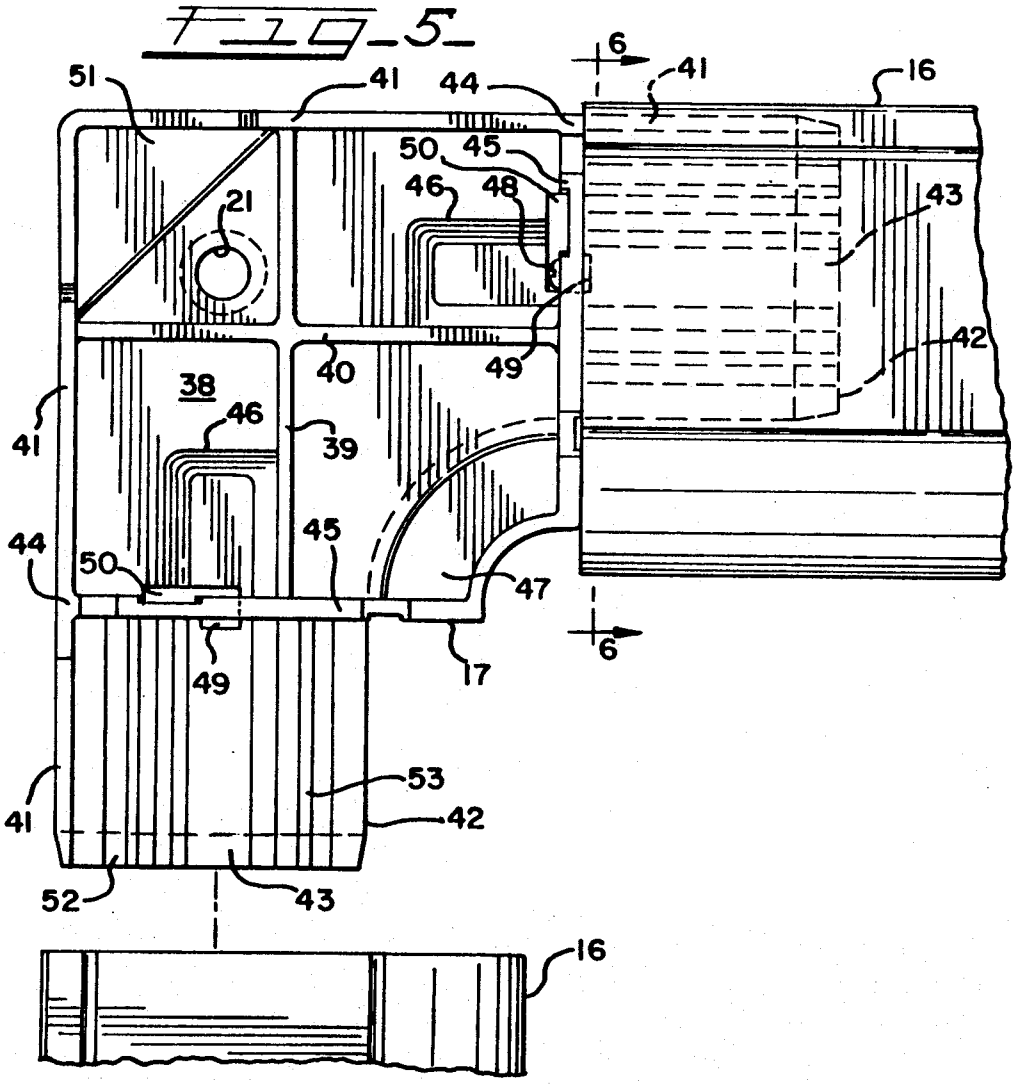
FIG. 5 is a plan view of a corner gusset for the trim frame assembly and showing one trim frame member spaced therefrom prior to attachment and another attached to the corner gusset.
Figure 7:
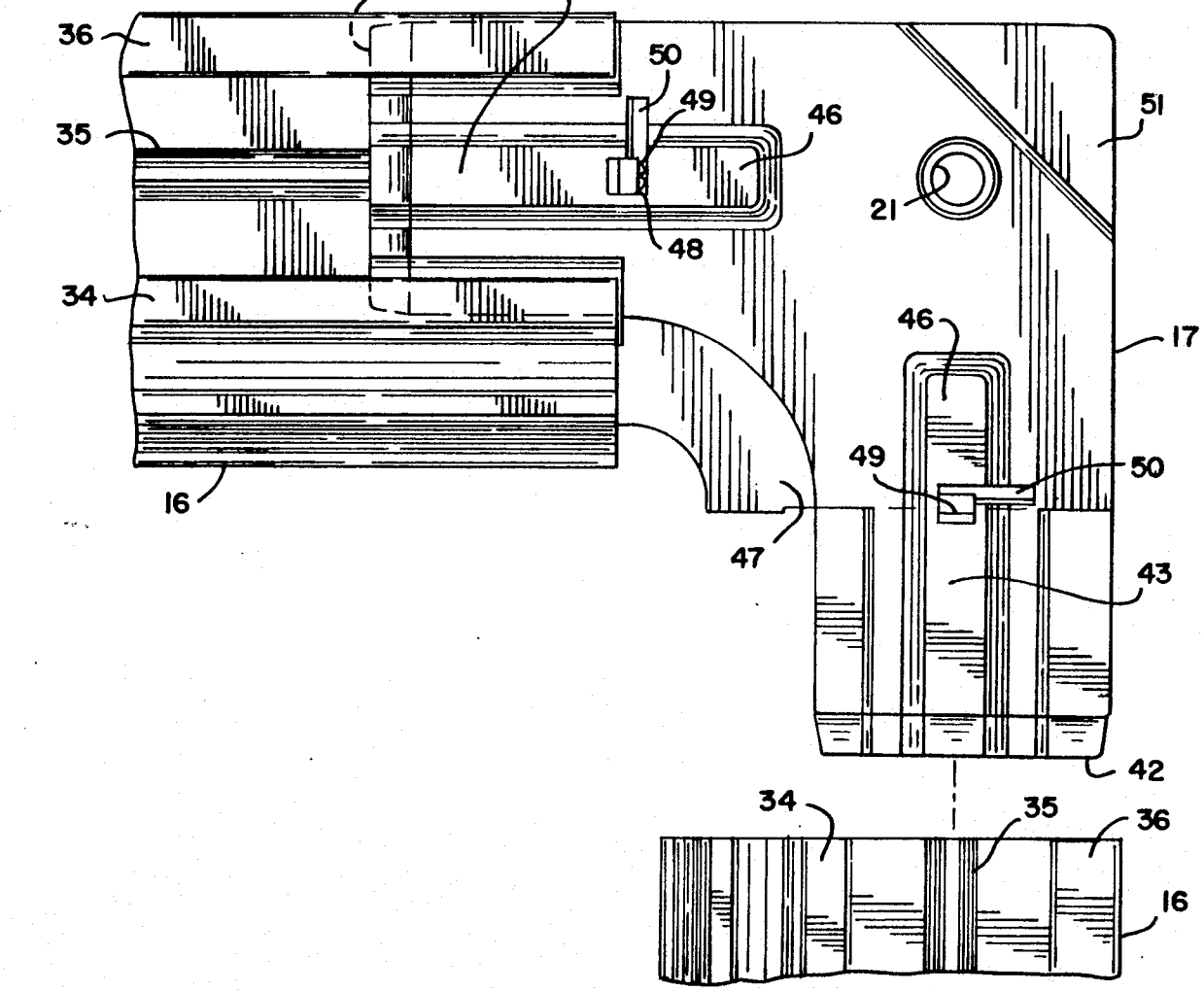
FIG. 7 is a plan view looking from the rear of the corner gusset as in FIG. 5 and having the one trim frame member attached and the one spaced therefrom ready for attachment thereto.

Looking at FIGS. 5-7, the interconnecting corner gusset 17 is illustrated in greater detail. FIG. 5 is a front plan view of the corner gusset 17 shown in FIGS. 1 and 2, having the vertically aligned trim frame member 16 spaced downwardly, and the horizontally aligned trim frame member 16 connected thereto, for better understanding of the structures and attachments. FIG. 6 is a cross-sectional view taken along lines 6—6 of FIG. 5, looking in the direction of the arrows, to show the mechanical fastening of the trim frame member 16 to the corner gusset 17. FIG. 7 is a plan view of the opposite side of the corner gusset 17 looking from the rear of FIG. 5.

The corner gusset 17 has a pan-like configuration having a generally flat plate portion 38 criss-crossed by reinforcing ribs 39, 40. Side walls 41 extend from the outward edges of the plate portion 38 and provide further rigidification to the corner gusset 17. The plate portion 38 includes transversely oriented reinforcement flanges 42 extending from the plate portion 38 to reside behind the trim frame members 16 and supportively slide within the channel means 33. The reinforcement flanges 42 accommodate the extrusion 39 underneath a raised crown 43 thereof.

With regard to FIG. 6, it will be seen that the walls 4 integrally extend along outward edges of the flanges 42 and nestably reside generally inside the top hook flanges 28 to provide reinforcement. At the junction of the flanges 42 with the plate portion 38, generally designated at 44, transverse upstanding interior walls 45 project from edges of the plate portion 38 and are arranged to abut outwardly against the ends of the trim frame members 16 when the flanges 42 are fully engaged therewith, as shown at the horizonal trim frame member 16 of FIG. 5. The plate portion 38 includes transverse depressions 46 for the purpose of providing a working space for a screwdriver, or the like, to be used to tighten fasteners attaching the trim frame member 16. A curved inward corner 47 of the plate portion 38 faces panel-inwardly and joins the walls 45. The gussets 17 are made of die-cast zinc in the preferred embodiment, which offers a sturdy solid corner connection at the four corners of the assembly 10.

The fastening of the trim frame members 16 to the Corner gusset 17 is provided by screw fasteners 48 projecting through apertures 49 in the walls 45 for thread-engagement with the extrusions 35 of the trim frame member 16. This screw attachment further provides self-alignment and adjustment capabilities in the attachment and interconnection of two trim frame members at a corner gusset 17. Accordingly, the screw fasteners 48 may be loosened and re-tightened to aid in adjusting the attachment of the assembly 10. The transverse depressions 46 will therefore be seen to permit access of a screwdriver tip to engage the screw fasteners 48, which also serve to help provide a reinforcement effect. Adjacent the apertures 49, cut-outs 50 are made through the walls 45 for the snap-engageable attachment of the corner trim caps 19 as will be explained hereinafter.

The side walls 41 are stepped down at a triangular corner 51. The walls 41 are stepped down in height around the triangular corner 51 in order to allow a screwdriver or the like to have coaxial alignment with screw fasteners 48 and either of the apertures 49 for fastening the trim frame member 16 to the corner gusset 17. The depressions 46 reside adjacent the apertures 49 and align with the screw fasteners 48 to provide the working space for a screwdriver, as explained.

To further facilitate reinforcement at the flanges 42, a triangular wedge-shaped wall 52 projects outwardly from the flange 42 generally parallel to the wall 41 to achieve a wedge-like nested arrangement against the interior face 25 of the connected trim frame member 16, best viewed in FIG. 6. In like manner, a shorter rib 53 projects, generally from the other side of the flange 42 for linear abutment against the interior face of the connected trim frame member 16, also best viewed in FIG. 6. A combination of the out-turned legs 41, triangular wedge-shaped wall 52, and rib 53, provides a rigidifying backing against the respective trim frame member 16 upon sliding the trim frame member 16 onto the respective flange 42 and the fastening of the screw fastener 48 thereat.

The corner gussets 17 and trim frame members 16 can be pre-assembled for later attachment to the support frame members 11, 12. Specifically, a vertical and a horizontal trim frame member 16 may be connected by one corner gusset 17 being attached thereto by screw fasteners 48. Thence, a pane of glass 18, or equivalent sheet material such as acrylic, and the like, is slid into the flexible glazing strips 37 within the channels 22 of the two interconnected trim frame members 16. Then, another vertical or other horizontal trim frame member 16 may be attached by a second corner gusset 17. Lastly, the fourth trim frame member 16, forming the fourth leg of the rectangular configuration, can be put into place having the other two corner gussets 17 attached thereto ready to be fastened to two parallel trim frame members 16 to complete the pre-assembly. The pre-assembled glazed frame, such as sub-assembly 15 in FIG. 1, can then be taken to the support frame members 11, 12 for attachment by screw fasteners passing through the four corner gusset apertures 21 to engage four receiving apertures 20*a, b, c*, etc., that are pre-drilled in the support frame members of a space divider system. It will be understood that the use of the term rectangular includes square sub-assemblies 15, 15' wherein the lengths of the trim frame members 16, 16' would be equal. The preferred embodiment shows a vertical spacing between the apertures 20*a, b, c*, etc., of about 12 inches, therefore allowing for a plurality of less-than-full-height frame assemblies 10 to be attached at one panel opening in a wall system. Also, known solid decorative panels may be installed above or below a less-than-full height assembly 10 in a variety of configurations as will be explained with respect to FIGS. 8–13. The attachment of the glazed trim frame sub-assembly 15 and the opposite trim frame sub-assembly 15' is simply made by the use of four screw fasteners making installation of a completed assembly 10 fast and accurate.

Alternately, the channels 22 may be provided with the decorative trim strips 37*a*, as shown in the cross-sectional view of FIG. 4, allowing for a panel to be open for use as a pass-through over desks and workstations, or to provide a more open ambiance for an office space divider system.

The trim frame sub-assemblies 15, 15', are formed to have the lower curved flanges 31, 31', respectively, oppose at lower edges 32, 32', in order to conceal the channel 22 and reside generally along the glazing strip 37 or a trim strip 37*a*. Viewed from either side of the glazed panel assembly 10, the appearance is therefore substantially identical.

Following the fastening of the trim frame sub-assemblies 15, 15' to the support frame members 11, 12, a final step involves the detachable engagement of the four corner trim caps 19 at each side 13, 14. With reference to FIGS. 2*a* and 2, it will be observed that the corner trim cap 19 includes a contoured face 54 which tapers to a corner edge 55 for meeting the contour of the adjoining transversely related trim frame members 16 or 16'. The corner trim cap 19 is generally pie-shaped having orthogonally disposed edges 56 and 57, which reside generally over the walls 45 of the corner gusset 17. As a result, there is provided even joints between the corner trim caps 19 and the two interconnected trim frame members 16 or 16', thereat. The corner trim caps 19 further include depending exterior orthogonal walls 58, 59, which depend from the contoured face 54 for a distance substantially the same as the hook flanges 28 of the trim frame members 16, and spaced to outwardly overlie the walls 41 of the gussets 17, to create a continuous exterior peripheral edge around all the corners between the surfaces of the adjacent flanges 28, as best viewed in FIG. 1.

The corner trim caps 19 are manually detachably engaged to the corner gusset 17 by the provision of upright snap-over tangs 60, 61. The upright snap-over tangs 60, 61 depend generally normal to the edges 56, 57, respectively, and terminate in barbed ends 62, 63, respectively, for attachment into the slots 50 of the walls 45 of the corner gusset 17. An overlap of the walls 58, 59 over the walls 41 also adds frictional holding engagement, in addition to the corner edge 55 overlapping the curved inward corner 47 of the corner gusset 17.

When the four corner trim caps 19 are placed on both sides of the assembly 10, a finished peripheral trim appearance is provided continuously around the frame border.

Turning now to FIGS. 8–13, it will be observed that the invention provides for the assembly 10 to be sized for various configurations in a wall system. For example, in FIG. 8, four panel sections A, B, C and D are provided for the purposes of illustration. At panel A, an assembly 10 is provided at the very top and has a height about 1/6 of the height of the panel section A. At B, C and D, the assemblies 10 step down to illustrate one configuration made possible by the invention. The portions above and below the assemblies 10 having the vertical highlighted lines, are illustrative of solid decorative panels, which maybe fabric covered acoustical panels, or other panel structures, well-known in the industry, and are generally designated at reference numeral 64 throughout. The panels 64 can likewise be manufactured at various heights to accommodate the variably sized assemblies 10.

The interchangeability afforded by the invention allows for rearranging panel openings to have a glazed panel assembly interchangeable with an open panel assembly, as well as being interchangeable with a solid decorative panel 64. Because only the corner gussets 17 are attached to the framing elements of a wall assembly, only eight attachments are affected when changing panel arrangements.

Figures 8, 9, 10, 11, 12, 13:
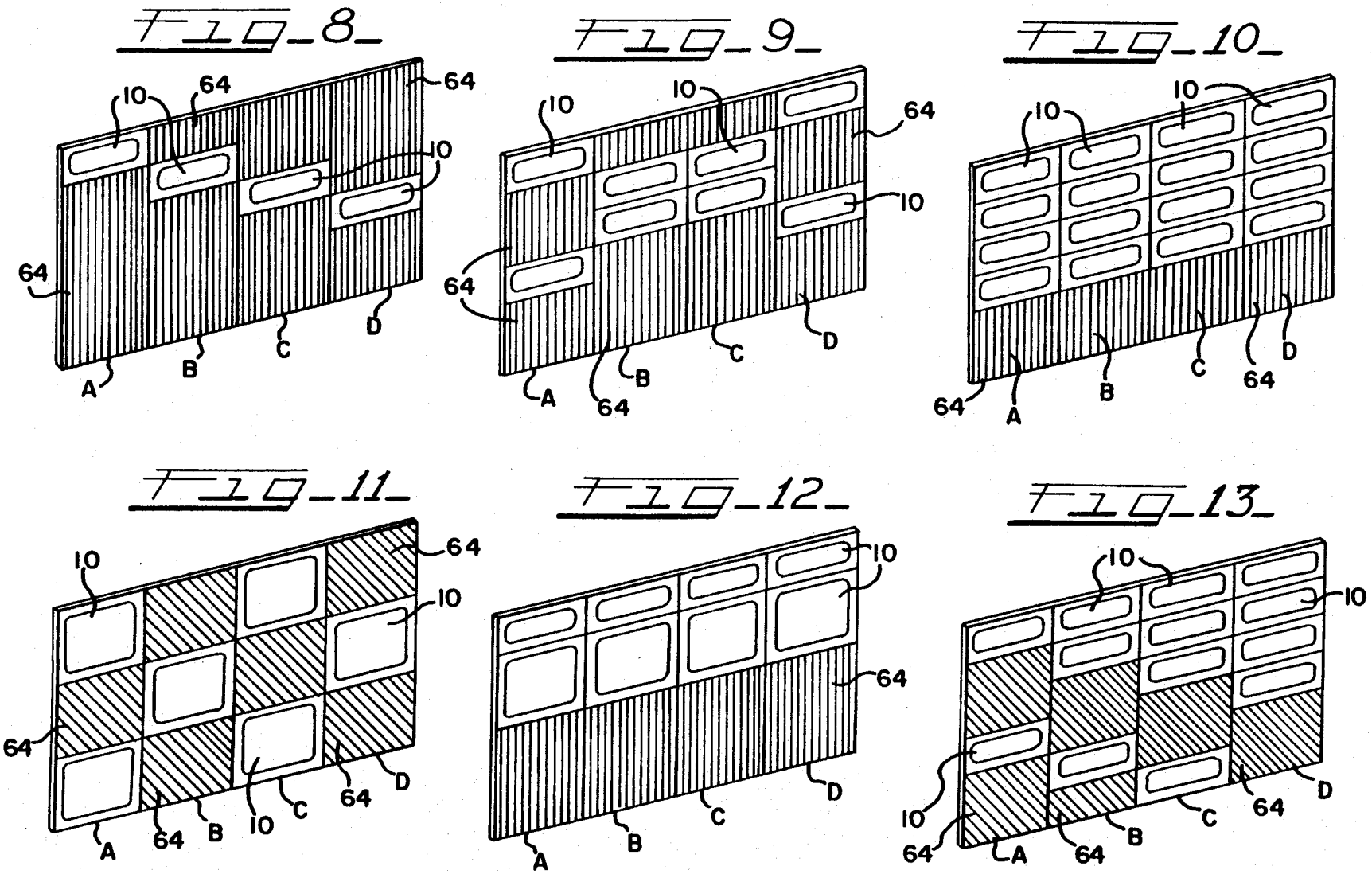
FIG. 8 shows four panels of a wall assembly having an arrangement of less-than-full-height glazed panels and decoratively covered panels in accord with the invention.
FIG. 9 is another arrangement of less-than-full-height glazed panels and decoratively covered panels.
FIG. 10 is another arrangement of less-than-full-height glazed panels shown in a stacked arrangement above four decoratively covered panels.
FIG. 11 is yet another arrangement of a combination of less-than-full-height glazed panels and decoratively covered panels of a wall assembly.
FIG. 12 illustrates another arrangement of various sized less-than-full-height glazed panels and decoratively covered panels; and, FIG. 13 shows still another arrangement of decoratively covered panels and less-than-full-height glazed panels.

In FIG. 9, the assembly 10 also has a height of about 1/6 of the height of the sections A–D. In FIG. 10 the top two-thirds of the sections A–D are provided with four smaller assemblies 10, each having about 1/6 the height of the sections A–D. The bottom ⅓ of each section has the decorative panel 64.

In FIG. 11, the assemblies 10 are provided to have about 1/3 the height of the wall of sections A–D and are arranged in a checkerboard-like arrangement with less-than-full height decorative panels 64. In FIG. 12, a combination of ⅓ height and 1/6 height assemblies 10 are provided to extend to the upper half of the sections A–D with the bottom half being covered by the decorative panels 64 having a height of ½ of the sections A–D. In FIG. 13, yet another arrangement of less-than-full height assemblies 10 is shown in combination with solid decorative panels 64 of various heights, demonstrating another of the myriad of configurations that the invention will permit for use in wall panel space divider systems. Some, or all, of the assemblies 10 may have glazing and otherwise may be provided with a trim strip 37*a* to provide the open, or pass-through, feature. These configurations can be changed at any wall location simply by removing a sub-assembly 15 at one side and replacing the glazing with a trim strip, or vice-versa.

While the trim frame members 16, 16' are disclosed to be preferably extruded aluminum, other materials are well-suited for use, including other metals, and extruded plastics, or other equivalent materials capable of taking the appropriate shape. Likewise, the corner gusset 17 and the corner trim caps 19 are disclosed to preferably comprise die-cast zinc, and other equivalent metals, or plastic materials, capable of being formed to provide the recited structural features may be used, as would be understood to those skilled in the art.

As a result, a wide scope of equivalent constructions and features fall within the scope of the claims appended hereto.

What is claimed is:

1. A wall panel assembly having a glazed panel, the glazed panel being mounted to wall framing members, the glazed panel comprising:

a first trim frame sub-assembly having upper, lower and opposing sides forming four corners, trim frame members being connected at the four corners, the trim frame members having panel-inward edges, panel-outward edges, an exterior trim face side and an opposite interior side forming a channel means and fastening means, trim flanges extending from the panel-outward edges of the trim frame members and glazing channels extending from the panel-inward edges of the trim frame members, corner gusset members connecting said trim frame members at the four corners, the corner gusset members being fastened to the wall framing members, and a pane member being peripherally retained in the glazing channels of said trim frame members; and, a second trim frame sub-assembly being attached to the wall framing members at a side opposite the first trim frame sub-assembly and having second upper, lower and opposing sides forming four second corners, second trim frame members being connected at said four second corners, the second trim frame members having second panel-inward edges, second panel-outward edges, a second exterior trim face side and a second opposite interior side forming a second channel means and second fastening means, a second trim flange extending from the second panel-outward edges of the second trim frame members, said second trim frame members terminating at said second panel-inward edges, the second panel-inward edges residing generally along the glazing channels of the first trim frame sub-assembly and wherein the second trim frame sub-assembly conceals a portion of the first trim frame sub-assembly glazing channels, second corner gusset members connecting said second trim frame members at the four second corners, the second corner gusset members being fastened to the wall framing members; and, corner trim means at both said four first and second corners and having means detachably engaging said corner gusset members and covering the corner gusset members, the corner trim means having panel-inward flanges terminating generally adjacent the panel-inward edges of said trim frame members; and, said glazed panel supported only by said first trim frame assembly, and said first and second trim frame assemblies being independently mountable to the wall framing members.

2. The wall panel assembly as claimed in claim 1 wherein the corner gusset members include reinforcing flanges extending within said channel means of the trim frame members.

3. The wall panel assembly as claimed in claim 1 wherein the corner trim means have snap-engagement means snap-engaged to the corner gusset members.

4. The wall panel assembly as claimed in claim 3 wherein the snap-engagement means comprise snap-over tangs engaging snap-over means of said corner gusset members.

5. The wall panel assembly as claimed in claim 1 wherein said trim frame members comprise extruded aluminum.

6. The wall panel assembly as claimed in claim 5 wherein the fastening means of the trim frame members comprise an elongate C-shaped tubular extrusion.

7. The wall panel assembly as claimed in claim 6 wherein the corner gusset members include reinforcing flanges having means for accommodating thereunder said tubular extrusion.

8. The wall panel assembly as claimed in claim 1 wherein said corner gusset members include screw fasteners therethrough engaging said wall framing members.

9. A pre-assembled glazing panel having a first and second trim frame assembly, the first trim frame assembly comprising:

four trim frame members being arranged to define four corners and corner gussets connecting the trim frame members at each said corner, the trim frame members having an exterior trim surface and a generally concavo-convex shape with an interior side including channel means, the corner gussets including rigidifying flanges engaging said channel means, said trim frame members having outward flanges extending therefrom and said rigidifying flanges of the corner gussets being formed with upstanding wall means being slidable behind said outward flanges of the trim frame members, said trim frame members further including inward flanges extending therefrom, said inward flanges each terminating at an integral glazing channel formed therewith, said corner gussets having fastener engageable means adjacent said trim frame members and said trim frame members including fastener receivable means, a fastener fastening said engageable means of the corner gussets to the fastener receivable means of the trim frame members for the connection therebetween; and corner trim cap members having snap-engageable means capable of being snap-engaged with said corner gussets;

the second trim frame assembly comprising:

a second assembly of four second trim frame members arranged to define four second corners and second corner gussets connecting the second trim frame members at each said corner, second corner trim cap members snap-engaging the second corner gussets, wherein said second trim frame members, second corner gussets and second corner trim cap members having substantially the same structure as in the first assembly with the exception of having a glazing channel; and wherein said inward flanges of both said trim frame assemblies capable of being opposingly directed across said glazing channel from opposite sides of a wall support frame; and, said trim frame assemblies being independently mountable at said opposite sides of a wall support frame.

10. The pre-assembled glazing panel as claimed in claim 9 wherein said engageable means of said corner gussets comprise slotted walls and the fastener receivable means of said trim members comprise elongated extruded tube-like portions for receiving screw fasteners.

11. The glazing panel as claimed in claim 9 wherein said corner gussets include means for fastening to a wall support frame.

12. The glazing panel as claimed in claim 9 wherein said channel means of said trim frame members comprise a return flange extending in a panel inward direction from said interior side and an opposing interior flange formed from said interior side to define therebetween a spacing, and wherein said corner gussets include extending reinforcing flanges within said spacing of the channel means for rigidification of said fastened trim frame members.

13. A pair of trim frames for mounting at an open panel of a wall system, each trim frame being substantially identical to the other trim frame with the exception of one of said trim frames including a channel means for receipt therein of a pane for disposing a pane on the one said trim frame for installation in a wall panel opening, said trim frames comprising:

four elongate trim frame members arranged in a rectangular configuration forming four right angle corners, the trim frame members being connected at the four corners by four corner gusset members, four corner trim caps covering said four corner gusset members, said trim frame members including panel-inward sides and panel-outward opposite sides, a central portion terminating in outward flanges at the panel-outward sides and the panel-inward sides terminating in inward flanges, the inward flanges of each trim frame being opposingly directed to the other;

said channel means of the one of the trim frames extending from said inward flanges and capable of receiving a pane;

said corner gusset members including reinforcing means extending behind the trim frame members connected thereat, said trim frame members including means for receiving the reinforcing means, and said corner gusset members further including means for fastening to said trim frame members; and, each of said trim frames being independently mountable at a wall panel opening.

14. A pair of trim frames for attachment at opposite sides of a rectangular opening in a wall system to fasten to and conceal structural support members of said wall system, comprising:

(a) a first trim frame having elongate trim frame members being connected to define four corners and forming a rectangular configuration, the trim frame members having central portions with front faces and back faces, outward flange portions and inward flange portions extending from the central portions, means for fastening to a corner gusset, and channel means being formed generally at the back faces;

four corner gussets each connecting two trim frame members at each of said four corners of said rectangular configuration and including reinforcing means engaging said channel means of the trim frame members, engagement means for fastening said four corner gussets to said means for fastening of the trim frame members, and means for attaching said four corner gussets to a wall system structural support members at one side of a rectangular opening in a wall system;

glazing channels formed with said first trim frame members and extending from said inward flange portions;

corner trim means for engaging each of said four corner gussets and concealing said corner gussets;

(b) a second trim frame having elongate second trim frame members being connected to define four second corners and forming a rectangular configuration, the second trim frame members having second central portions with second front faces and second back faces, and second outward flange portions and second inward flange portions extending from the second central portions, second means for fastening to a corner gusset, and second channel means formed generally at the second back faces;

four second corner gussets each connecting two second trim frame members at each of said four second corners of said rectangular configuration and including second reinforcing means engaging said second channel means of the second trim frame members, second engagement means for fastening said four second corner gussets to said second means for fastening of the second trim frame members, and second means for attaching said four second corner gussets to a wall system structural support members opposite and independently of the first trim frame;

second corner trim means for engaging each of said four second corner gussets and concealing said four second corner gussets.

15. The pair of trim frames as claimed in claim 14 further comprising a pane peripherally engaged at said glazing channels of said first trim frame members.

16. The pair of trim frames as claimed in claim 15 wherein said pane comprises a sheet of glass.

17. The pair of trim frames as claimed in claim 15 wherein said pane comprises a sheet of acrylic.

18. The pair of trim frames as claimed in claim 15 wherein said first and second trim frame members comprise extruded aluminum.

19. The pair of trim frames as claimed in claim 15 wherein trim means are disposed in said glazing channels.

* * * * *